US006882323B2

(12) United States Patent
Peebles et al.

(10) Patent No.: US 6,882,323 B2
(45) Date of Patent: Apr. 19, 2005

(54) MULTI-BEAM ANTENNA SYSTEM WITH SHAPED REFLECTOR FOR GENERATING FLAT BEAMS

(75) Inventors: Ann L. Peebles, Santa Monica, CA (US); Alan R. Cherrette, Hermosa Beach, CA (US); Stuart T. Linsky, Rancho Palos Verdes, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/434,100

(22) Filed: May 9, 2003

(65) Prior Publication Data

US 2004/0222932 A1 Nov. 11, 2004

(51) Int. Cl.[7] ..... H01Q 19/10
(52) U.S. Cl. ..... 343/781 R; 343/781 P
(58) Field of Search ..... 343/781 R, 781 P, 343/781 CA, 837, 840

(56) References Cited

U.S. PATENT DOCUMENTS 4,298,877 A * 11/1981 Sletten ..... 343/781 CA
4,535,338 A * 8/1985 Ohm ..... 343/781 CA
6,211,835 B1 4/2001 Peebles et al. ..... 343/781 P

* cited by examiner

*Primary Examiner*—Michael C. Wimer
(74) *Attorney, Agent, or Firm*—Posz Law Group, PLC

(57) ABSTRACT

A side-fed dual reflector antenna system (10) of the present invention overcomes the size cost and complexity limitations associated with conventional single and multiple reflector antenna systems. The antenna system (10) includes a feed array (18) including separate feeds for generating separate respective antenna beams, a subreflector (20) for reflecting the separate respective antenna beams generated by the separate feeds of the feed array (18), and a reflector (22) having a shaped reflecting surface for reflecting the separate respective antenna beams received from the subreflector (20) toward a terrestrial target (16) to produce substantially contiguous flat beams, each of which provides substantially uniform coverage within a predetermined coverage area on the terrestrial target. The subreflector (20) and each of the separate feeds in the feed array (18) are arranged so that a center of each of the separate respective antenna beams illuminates a center of the reflector (22) subsequent to being reflected from the subreflector (20).

16 Claims, 5 Drawing Sheets

| Beam # | AZ | EL | PK Dir | eoc (1.0 deg) | eoc (1.2 deg) | SLL |
|---|---|---|---|---|---|---|
| 1 | 0.00 | 0.00 | 45.03 | 42.56 | 42.56 | -22.81 |
| 2 | 1.00 | 0.00 | 45.02 | 42.43 | 42.43 | -22.78 |
| 3 | 2.00 | 0.00 | 45.01 | 42.29 | 42.29 | -22.75 |
| 4 | 3.00 | 0.00 | 45.01 | 42.12 | 42.12 | -22.67 |
| 5 | 4.00 | 0.00 | 44.99 | 41.92 | 41.92 | -22.56 |
| 6 | 5.00 | 0.00 | 44.98 | 41.72 | 41.72 | -22.43 |
| 7 | 0.00 | 1.00 | 45.22 | 42.49 | 42.49 | -23.14 |
| 8 | 0.00 | 2.00 | 45.40 | 42.37 | 42.37 | -23.58 |
| 9 | 0.00 | 3.00 | 45.59 | 42.19 | 42.19 | -24.13 |

Figure 3

MULTI-BEAM ANTENNA SYSTEM WITH SHAPED REFLECTOR FOR GENERATING FLAT BEAMS

FIELD OF THE INVENTION

This invention relates generally to antennas and, more particularly, to an antenna system with a shaped reflector that is capable of achieving a full earth field-of-view with contiguous flat, low crossover beams.

BACKGROUND

Conventional commercial and military satellite communications applications require a high downlink effective isotropic radiated power (EIRP) and a high uplink gain/temperature ratio (G/T) to close the communications link between, for example, a satellite and a ground station. These higher downlink and uplink requirements require the use of a high gain antenna system, which in turn results in smaller beam size. For cellular earth field of view (EFOV) coverage, a multi-beam antenna system must be utilized in which the antenna provides a beam scan capability of up to 15 beamwidths away from the antenna boresight with low scan loss and minimal beam distortion. Multiple aperture reflector antenna systems with interleaved beams, or a single aperture reflector antenna system using shared feeds to generate contiguous earth coverage beams, are typically deployed.

However, the multiple aperture reflector antenna systems require a significant amount of hardware and complex spacecraft packaging that result in a high overall system cost. A single aperture reflector antenna system with shared feeds also is expensive, as the beam-forming network that must be used due to the fact that each of the feeds is shared by more than one beam is highly complex. In addition, such a system has a high associated beam-forming network loss and relatively large overall weight.

Therefore, it is an object of the present invention to provide a multi-beam satellite antenna system with a single aperture shaped reflector that optimizes beam crossover and overall system size, cost and complexity.

It is another object of the present invention to provide a single aperture side-fed dual reflector antenna system that generates substantially contiguous flat beams, each of which provides substantially uniform coverage within a predetermined coverage area on the terrestrial target.

SUMMARY OF THE INVENTION

In view of the above and according to one embodiment of the present invention, a single aperture side-fed dual reflector antenna system according to a preferred embodiment of the present invention includes a feed array with separate feeds for generating separate respective antenna beams, a subreflector for reflecting the separate respective antenna beams generated by the separate feeds of the feed array, and a main reflector having a shaped reflecting surface for reflecting the separate respective antenna beams received from the subreflector toward a terrestrial target in a manner that produces substantially contiguous flat beams. Each of the substantially contiguous flat beams provides substantially uniform coverage within a predetermined coverage area. The subreflector and each of the separate feeds in the feed array are arranged so that a center of each of the separate respective antenna beams illuminates the center of the shaped main reflector subsequent to being reflected from the subreflector.

According to another preferred embodiment of the present invention, a single aperture offset reflector antenna system includes a feed array with separate feeds for generating separate respective antenna beams, and a reflector having a shaped reflecting surface for receiving the separate respective antenna beams from the feed array and for reflecting the separate respective antenna beams toward a terrestrial target in a manner that produces contiguous flat beams, each of which defines a coverage cell within a predetermined coverage area. Each of the separate feeds is arranged so that a center of each of the separate respective antenna beams illuminates a reflector center.

BRIEF DESCRIPTION OF THE DRAWINGS

FIG. 3 is a table of simulated operating parameters of the side-fed dual reflector antenna system of the present invention;

DESCRIPTION OF THE PREFERRED EMBODIMENTS

Figure 1:
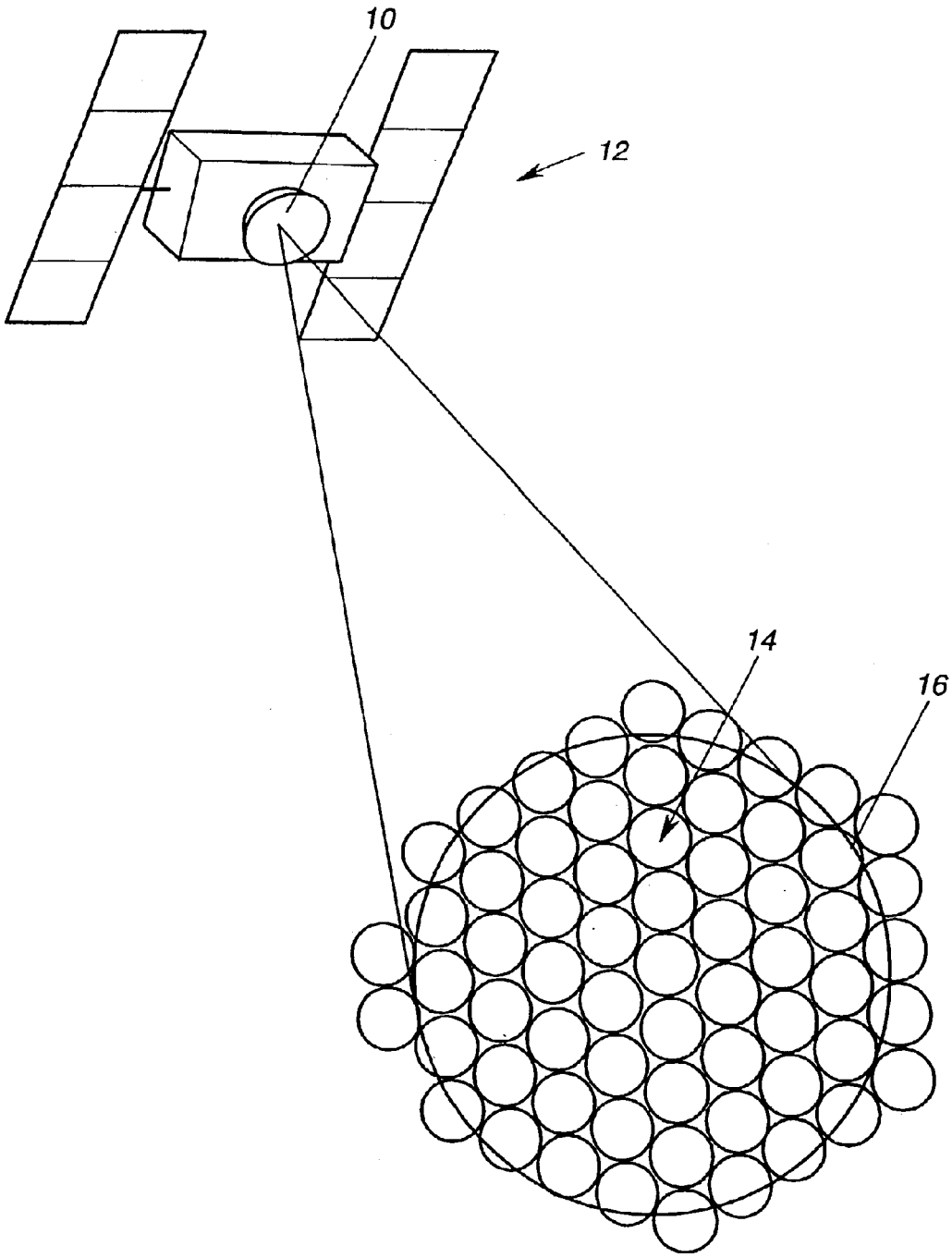
FIG. 1 is an isometric view of a satellite including a side-fed dual reflector antenna system according to a preferred embodiment of the present invention.

Referring now to the drawings in which like numerals reference like parts, FIG. 1 shows a single side-fed dual reflector antenna system (antenna system) 10 according to a preferred embodiment of the present invention. Generally, the antenna system 10 is deployed on a spacecraft, such as a geosynchronous communications satellite, 12, and is designed to transmit and receive communications signals, hereinafter referred to as antenna beams, across inter-satellite communications links and satellite-terrestrial communications links. More specifically, as shown in FIG. 1, the antenna system 10 is designed to produce contiguous flat antenna beams, represented by cells 14, on a terrestrial target coverage area (coverage area), such as Earth, 16 with low crossover for full cellular EFOV coverage without the need for shared feeds or multiple antenna systems.

Figure 2:
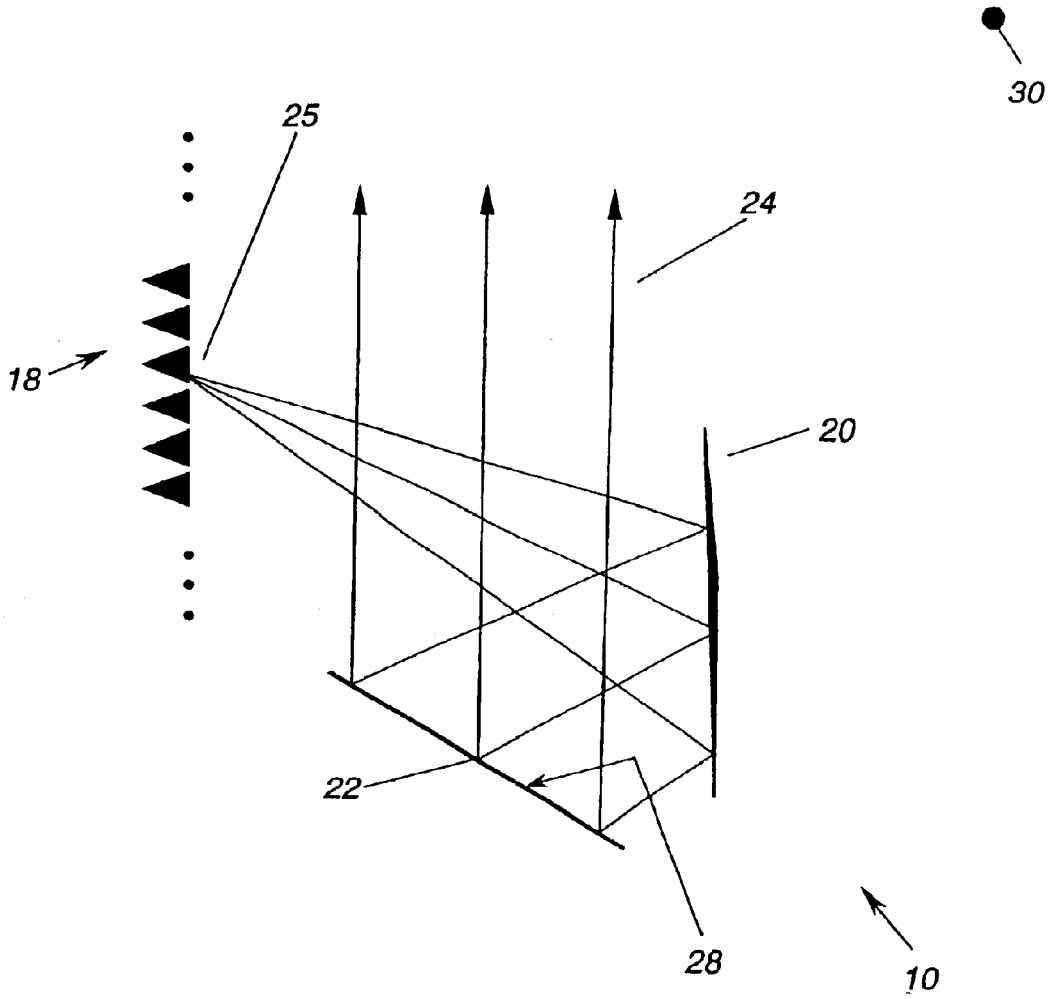
FIG. 2 is a side elevation view showing the side-fed dual reflector antenna system of the present invention in more detail.

Referring now to FIG. 2, the antenna system 10 includes a feed array 18, a subreflector 20 and a main shaped reflector (reflector) 22. The antenna system 10 of the preferred embodiment is designed to transmit and receive signals with antenna beams in the microwave frequency range, such as Ka band (20–30 GHz); however, the antenna system 10 may be designed to transmit and receive antenna beams in any commercial or military communications frequency bands.

The feed array 18 includes several separate antenna beam feeds, such as feed horns, for generating separate respective antenna beams. Although only one ray trace 24, which represents a beam path of one antenna beam emanating from a single beam feed in the feed array 18 during beam scanning, is shown, one skilled in the art will appreciate that like antenna beams emanate from the other respective beam feeds in the feed array 18 during beam scanning in a similar, albeit angularly offset, manner when compared to the ray trace 24. The diameter of each of the feeds in the feed array 18 is preferably about 6.0λ, but may vary depending upon beam edge of coverage (EOC) and sidelobe level parameters. The average allowable spacing between each of the individual feeds depends on the desired beam spacing in a desired coverage area. For example, in the present embodiment, if the desired beam spacing is 1° for 1° diameter antenna beams, the average allowable feed spacing from 0° to 9° in azimuth/elevation scanning directions for the antenna system 10 is 6.4λ, assuming that it takes 9 beams from 0° azimuth/elevation, which corresponds to, for example, an EFOV center, to reach the edge of the EFOV. Although the specific dimensions of the antenna system 10 may vary depending upon the particular application, each of the separately generated antenna beams illuminates a center of the reflector 22 subsequent to being reflected from the subreflector 20 to generate nearly symmetrical far field beams up to a beam scanning range of approximately 11° from the antenna boresight, which is shown together with the feed array 18 in FIG. 2 and which represents the directivity of the antenna system 10 pointing to a center of the coverage area 16 in FIG. 1.

Referring again to FIG. 2, the subreflector 20 is a concave elliptical projection hyperboloidal subreflector. The subreflector 20, when implemented with the main reflector 22 having dimensions discussed below, preferably has elliptical aperture dimensions of about 191λ×172λ, a focal point located at 25 and, together with the separate feeds in the feed array 18, defines a sub-tended angle of approximately 22°. The slightly larger dimensions of the subreflector 20 enable spillover loss to be minimized among all beams generated by the feed array 18 within the EFOV. The focal length of the subreflector 20 may vary based on the shaping of the reflector 22.

While the subreflector 20 has been described as a concave elliptical projection hyperboloidal subreflector, the subreflector 20 may in fact be any subreflector capable of projecting each antenna beam output from the feed array 18 onto the reflector 22 so that the center of each antenna beam illuminates the center of the reflector 22. For example, although the subreflector 20 in the above-discussed preferred embodiment is a concave hyperboloidal subreflector, it is also contemplated that a concave ellipsoidal subreflector may alternatively be used when designed to have dimensions that enable it to be implemented with the reflector 22.

Still referring to FIG. 2, the reflector 22 is a shaped reflector having a shaped reflection surface 28 for receiving the separate respective antenna beams reflected from the subreflector 20 and for reflecting the separate respective antenna beams in a manner that produces substantially contiguous flat beams, each of which provides substantially uniform coverage within the coverage area 16 (FIG. 1). When implemented with the subreflector 20 having the above-discussed design parameters, the reflector 22 preferably is a circular projection shaped reflector with an aperture diameter of approximately 154λ, a virtual feed point located at 30 and a main focal length of 586λ. The virtual feed point 30 is referred to as such rather than as a focal point because the shaped reflection surface 28 of the reflector 22 is not a paraboloidal surface, but rather is a distorted paraboloidal surface. However, the antenna system 10 may also be designed with a shorter f/d ratio depending upon beam scanning requirements. In addition, the reflector 22 is positioned relative to the subreflector 20 so that a distance between the focal point 25 of the subreflector 20 and the virtual feed point 30 of the reflector 22 is approximately 852λ.

The reflector 22 is shaped based on EOC requirements using conventional reflector shaping software, such as the commercially available reflector shaping software package manufactured by TICRA under the name Physical Optics Shaping (POS). More specifically, the reflector 22 is shaped to optimize EOC requirements based on the assumption that the separate feeds in the feed array 18 are properly located so that the center of each separately generated antenna beam illuminates a center of the reflector 22 subsequent to being reflected from the subreflector 20. Feed location optimization can be determined using methodologies such as those disclosed in U.S. Pat. No. 6,211,835 to Peebles, et al., assigned to *Northrop Grumman Corporation* (assignee of the present invention), and entitled "Compact Side-Fed Dual Reflector Antenna System For Providing Adjacent, High Gain Antenna Beams," the contents of which are incorporated herein by reference.

For example, if the antenna system 10 were implemented in an application with 1° EOC directivity requirements, the shape of the reflector 22 would be designed accordingly to meet these requirements. As the reflector 22 reflects the antenna beams from each of the respective beam feeds in the feed array 18 in a nearly symmetrical manner to ensure symmetrical far field beams, the reflector 22 is shaped to flatten the antenna beams reflected therefrom and to optimize beam crossover levels. Put another way, the antenna gain of each of the antenna beams is distributed more evenly, thereby providing more uniform coverage across each of the coverage cells 14 and consequently across the entire beam coverage area 16 (see FIG. 1).

FIG. 3 illustrates simulated performance results of the antenna system 10 for both a 1° EOC and a 1.2° EOC. AZ and EL represent the respective azimuth and elevation scanning directions of the antenna system 10, AZ=0.00, EL=0.00 represents the arbitrarily located center of an EFOV, PK Dir represents the peak directivity of the beam, SLL=side lobe level relative to the beam peak outside of a 1.5° radius (the co-pol interference region assuming 1.0° beam spacing). As indicated, the decrease in antenna gain from the peak directivity to the EOC is no greater than about 3.4 dB, compared to about 6 dB in the above discussed multiple sidefed dual reflector antenna systems conventionally used together to achieve full EFOV with contiguous beams. Further, system performance when EOC=1.0 and when EOC=1.2 is identical, thus indicating that the flat beams produced by the shaped surface of the reflector 22 provide a larger, more uniform coverage area and similar carrier to interference ratio (C/I) performance when compared to, for example, the above-discussed multiple sidefed dual reflector antenna systems.

Figure 4:
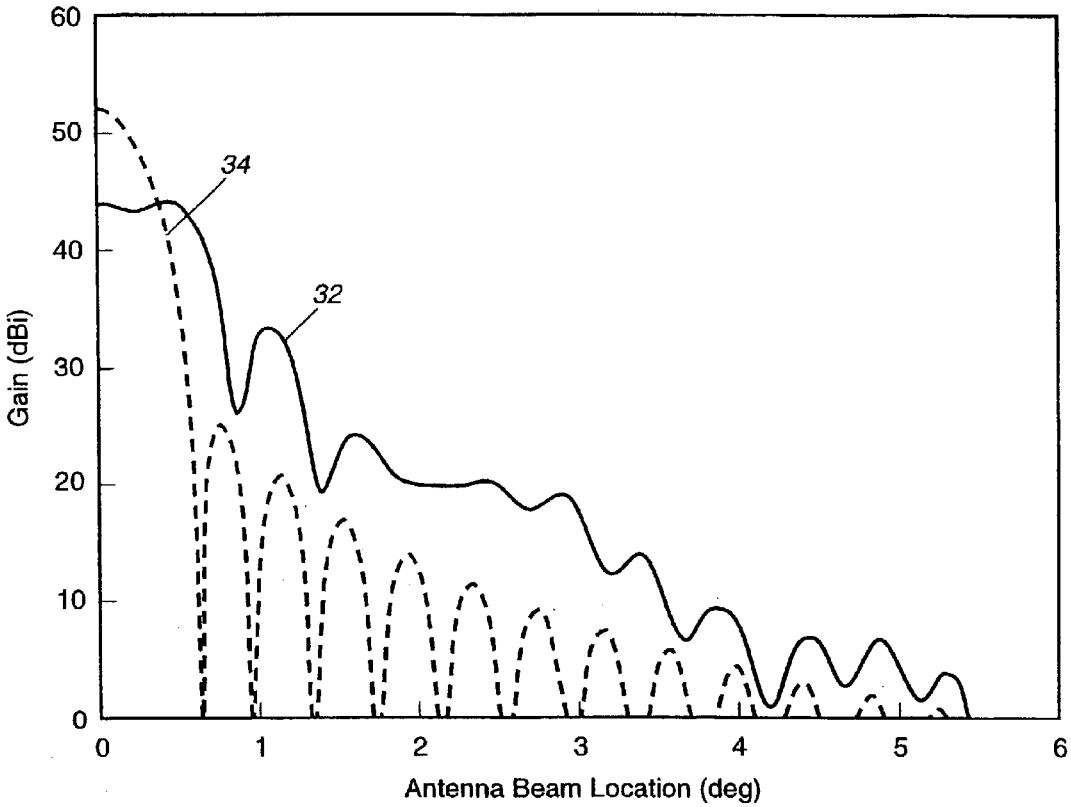
FIG. 4 is a graph of antenna beam angle versus gain for both the reflector in the side-fed dual reflector with a shaped main reflector antenna system of the present invention and a side-fed dual reflector with a conventional parabolic main reflector.

FIG. 4 is a graph specifically illustrating how the shaping of the reflector 22 in FIG. 2 flattens or, in other words, more evenly distributes the antenna gain of an exemplary antenna beam output from one of the individual feeds in the feed array 18 in FIG. 2. Specifically, the antenna gain, represented graphically by the solid line at 32, associated with the reflector 22 has a maximum gain of about 45 dBi with minimum spill out to an approximately 1° beamwidth, and thereafter maintains a greater average antenna gain than, for example, the antenna gain, represented graphically by the dashed line at 34, associated with a conventional non-distorted parabolic reflector (not shown).

Figure 5:
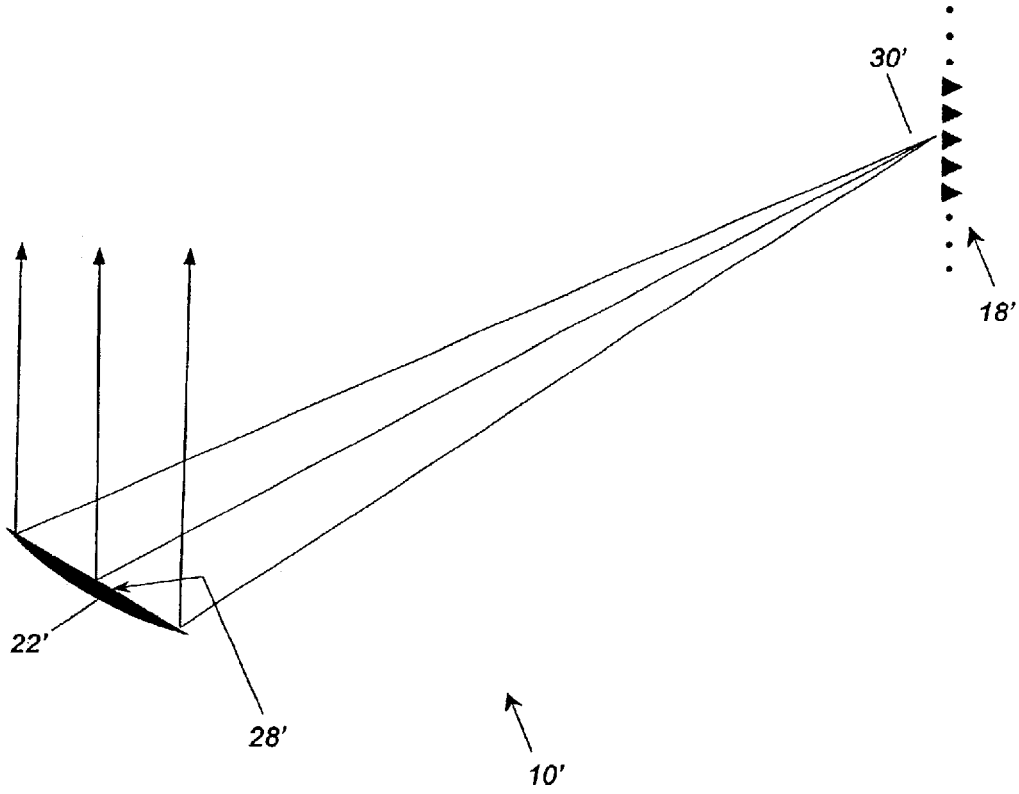
FIG. 5 is a side elevation view showing a side-fed single reflector antenna system according to another preferred embodiment of the present invention.

FIG. 5 shows an antenna system 10' according to a second preferred embodiment of the present invention. The antenna system 10' is a single offset reflector antenna system including a feed array 18' with separate feeds for generating separate respective antenna beams. As in the antenna system 10 in FIG. 1, each of the separate feeds in the feed array 18' is arranged so that a center of each of the separate respective antenna beams illuminates a center of the main reflector 22'. In addition, the antenna system 10' includes a main reflector 22' having a shaped reflection surface 28'. The shaped reflection surface 28' is shaped in a manner identical to the manner in which the shaped reflection surface 28 in the first preferred embodiment is shaped. The shaped reflection surface 28' is for receiving the separate respective antenna beams from the feed array 18', the center of which is located at the virtual feed point 30' of the reflector 22', and for reflecting the separate respective antenna beams toward a coverage area (not shown) such as Earth to produce contiguous flat beams, each of which defines a coverage cell within a predetermined coverage area. Therefore, the antenna system 10' is capable of producing a coverage area in a manner similar to that of the antenna system 10 of the first preferred embodiment without a subreflector. The antenna system 10' therefore can be implemented for use in an application in which size or packaging requirements are not as critical, and for less cost, compared to a single side-fed dual reflector antenna system such as the antenna system 10, while still achieving acceptable beam coverage results.

While the above description is of the preferred embodiment of the present invention, it should be appreciated that the invention may be modified, altered, or varied without deviating from the scope and fair meaning of the following claims.

What is claimed is:

1. A side-fed dual reflector antenna system comprising:

a feed array including separate feeds for generating separate respective antenna beams;

a subreflector for reflecting the separate respective antenna beams generated by the separate feeds of the feed array; and a reflector having a shaped reflection surface for reflecting the separate respective antenna beams received from the subreflector toward a terrestrial target in a manner that produces substantially contiguous flat beams, each of which provides substantially uniform coverage within a predetermined coverage area on the terrestrial target;

the subreflector and each of the separate feeds in the feed array being arranged so that a center of each of the separate respective antenna beams illuminates a center of the reflector subsequent to being reflected from the subreflector.

2. The side-fed dual reflector antenna system of claim 1, wherein the predetermined coverage area comprises an earth field of view coverage area.

3. The side-fed dual reflector antenna system of claim 1, wherein the each of the separate respective antenna beams illuminates the center of the reflector subsequent to being reflected from the subreflector to generate nearly symmetrical far field beams up to a beam scanning range of approximately 15 beamwidths from an antenna aperture.

4. The side-fed dual reflector antenna system of claim 1, wherein:

the reflector has a diameter of 154λ, where λ is an antenna beam wavelength; and the subreflector comprises a 191λ×172λ elliptical projection concave hyperboloidal subreflector.

5. The side-fed dual reflector antenna system of claim 4, wherein:

the reflector has a virtual feed point length of approximately 586λ;

a distance between a virtual feed point of the reflector and a focal point of the concave hyperboloidal subreflector is approximately 852λ.

6. The side-fed dual reflector antenna system of claim 1, wherein:

an average allowable feed spacing from 0° to 9° in scanning coordinates is 6.4λ with approximately 1° beam spacing, where λ is an antenna beam wavelength.

7. The side-fed dual reflector antenna system of claim 1, wherein the concave subreflector comprises a concave hyperboloidal subreflector.

8. The side-fed dual reflector antenna system of claim 1, wherein the concave subreflector comprises a concave ellipsoidal subreflector.

9. The side-fed dual reflector antenna system of claim 1, wherein the substantially uniform coverage comprises an area of coverage in which a decrease in antenna gain from a peak directivity to an edge of coverage is no greater than about 3.4 dB with a 1.0° to 1.2° edge of coverage.

10. The side-fed dual reflector antenna system of claim 1, wherein the shaped reflection surface comprises a distorted paraboloidal surface configured for producing the substantially contiguous flat beams.

11. A single offset reflector antenna system comprising:

a feed array including separate feeds for generating separate respective antenna beams;

a reflector having a shaped reflection surface for receiving the separate respective antenna beams from the feed array and for reflecting the separate respective antenna beams toward a terrestrial target in a manner that produces contiguous flat beams, each of which defines a coverage cell within a predetermined coverage area on the terrestrial target;

each of the separate feeds in the feed array being arranged so that a center of each of the separate respective antenna beams illuminates a center of the reflector.

12. The single offset reflector antenna system of claim 11, wherein the shaped reflection surface comprises a distorted paraboloidal surface configured for producing the substantially contiguous flat beams.

13. The single offset reflector antenna system of claim 11, wherein the predetermined coverage area comprises an earth field of view coverage area.

14. The single offset reflector antenna system of claim 11, wherein the each of the separate respective antenna beams illuminates the center of the reflector to generate nearly symmetrical far field beams up to a beam scanning range of approximately 15 beamwidths from an antenna aperture.

15. The side-fed dual reflector antenna system of claim 11, wherein the coverage cell defined by each of the contiguous flat beams has an associated decrease in antenna gain from peak directivity to a predetermined edge of coverage directivity of no more than approximately 3.4 dB.

16. The side-fed dual reflector antenna system of claim 15, wherein the predetermined edge of coverage directivity is between approximately 1° and 1.2°.

* * * * *